US009631262B2

(12) United States Patent
Wright et al.

(10) Patent No.: US 9,631,262 B2
(45) Date of Patent: Apr. 25, 2017

(54) COBALT ALLOYS

(71) Applicant: QuesTek Innovations LLC, Evanston, IL (US)

(72) Inventors: James A. Wright, Los Gatos, CA (US); Jeremy Hoishun Li, Sunnyvale, CA (US)

(73) Assignee: QUESTEK INNOVATIONS LLC, Evanston, IL (US)

( * ) Notice: Subject to any disclaimer, the term of this patent is extended or adjusted under 35 U.S.C. 154(b) by 678 days.

(21) Appl. No.: 14/012,567

(22) Filed: Aug. 28, 2013

(65) Prior Publication Data

US 2014/0060707 A1 Mar. 6, 2014

Related U.S. Application Data

(60) Provisional application No. 61/693,894, filed on Aug. 28, 2012.

(51) Int. Cl.

| | |
|---|---|
| ***C22C 19/07*** | (2006.01) |
| ***C22F 1/10*** | (2006.01) |
| ***C22F 1/16*** | (2006.01) |
| ***B22D 21/00*** | (2006.01) |
| ***C22C 1/02*** | (2006.01) |
| ***C22C 1/04*** | (2006.01) |

(52) U.S. Cl.

CPC ..... *C22C 19/07* (2013.01); *B22D 21/005* (2013.01); *C22C 1/02* (2013.01); *C22C 1/0433* (2013.01); *C22F 1/10* (2013.01); *C22F 1/16* (2013.01)

(58) Field of Classification Search

CPC ..... C22C 19/07; C22C 1/02; C22C 1/0433; C22F 1/10; C22F 1/16; B22D 21/005

See application file for complete search history.

(56) References Cited

U.S. PATENT DOCUMENTS

| | | | |
|---|---|---|---|
| 4,003,765 | A | 1/1977 | Davidson |
| 4,459,263 | A | 7/1984 | Prasad |
| 5,002,731 | A | 3/1991 | Crook et al. |
| 2004/0129349 | A1 | 7/2004 | Lindigkeit |
| 2005/0232806 | A1 | 10/2005 | Lindigkeit |
| 2006/0134454 | A1 | 6/2006 | Sathian |
| 2008/0185078 | A1 | 8/2008 | Ishida et al. |
| 2008/0260570 | A1 | 10/2008 | Harada et al. |
| 2011/0194971 | A1 | 8/2011 | Harada et al. |

FOREIGN PATENT DOCUMENTS

| | | |
|---|---|---|
| CN | 101592187 | 12/2009 |
| WO | 2010/101899 | 9/2010 |

OTHER PUBLICATIONS

Tongzheng, He, English machine translation of CN 101592187, Dec. 2009, p. 1-12.*

Ingesten et al., "Microstructural stability of strengthened Co—Cr—Ti alloys," Metal Science vol. 17 (Apr. 1983) pp. 159-166.

Sato et al., "Cobalt-Base High-Temperature Alloys," Science vol. 312 (Apr. 7, 2006) pp. 90-91.

International Search Report and Written Opinion for Application No. PCT/US2013/057051 dated Aug. 21, 2014 (10 pages).

* cited by examiner

*Primary Examiner* — Roy King
*Assistant Examiner* — Caitlin Kiechle
(74) *Attorney, Agent, or Firm* — Michael Best & Friedrich LLP

(57) ABSTRACT

Alloys, processes for preparing the alloys, and manufactured articles including the alloys are described. The alloys include, by weight, about 10% to about 20% chromium, about 4% to about 7% titanium, about 1% to about 3% vanadium, 0% to about 10% iron, less than about 3% nickel, 0% to about 10% tungsten, less than about 1% molybdenum, and the balance of weight percent including cobalt and incidental elements and impurities.

20 Claims, 6 Drawing Sheets

10

COBALT ALLOYS

CROSS-REFERENCE TO RELATED APPLICATIONS

This application claims priority to U.S. Provisional Application No. 61/693,894, filed Aug. 28, 2012, the contents of which are fully incorporated herein by reference.

STATEMENT OF GOVERNMENT INTEREST

This invention was made with government support under Contract No. M67854-10-C-6502 awarded by the U.S. Department of Defense, and under Contract No. W912HQ-11-C-0031 awarded by the Strategic Environmental Research and Development Program of the U.S. Department of Defense. The government has certain rights in the invention.

BACKGROUND

Copper-beryllium alloys are widely used in a variety of applications such as aerospace bushings and machine gun liners. Exposure to beryllium, however, can cause an often-fatal lung illness. Thus, the art has developed a need for alloys including, but not limited to, beryllium-free alloys with mechanical and tribological properties competitive to those of copper-beryllium alloys.

DETAILED DESCRIPTION

Aspects relate to an alloy and a manufactured article comprising the alloy as described herein. It should be understood that the disclosure is not limited in application to the details of construction and the arrangements of the components set forth in the following description. Other aspects and embodiments will be apparent in light of the following detailed description.

As used herein, terms such as "face-centered cubic" or "FCC," "hexagonal close-packed" or "HCP," "primary carbide," and "$L1_2$ phase" include definitions that are generally known in the art.

Any recited range described herein is to be understood to encompass and include all values within that range, without the necessity for an explicit recitation. Use of the word "about" to describe a particular recited amount or range of amounts is meant to indicate that values very near to the recited amount are included in that amount, such as, but not limited to, values that could or naturally would be accounted for due to instrument and/or human error in forming measurements.

In a general sense, the inventors have unexpectedly found new compositions of beryllium-free alloys that achieve nano-scale precipitation strengthening in a cobalt-based FCC matrix. It is contemplated that the low stacking-fault energy of the cobalt-based FCC matrix in an alloy with more than about 10% Cr in weight percentage results in good wear resistance and a high work hardening rate. The disclosed alloys include a suitable content of chromium to provide good resistance to corrosion and erosion. Known cobalt-based alloys such as ACUBE 100 by Carpenter Technology Corporation achieve strength predominantly through warm working, with a nominal composition in weight percentage of 28% Cr, 5.5% Mo, 0.7% Mn, 0.6% Si, 0.17% N, 0.05% C, up to 1% Fe, up to 1% Ni, and the balance Co and incidental elements and impurities. The applicable product size of ACUBE 100 is thus typically limited to less than 4 inches in diameter. Moreover, when tempered at 700° C.-850° C., ACUBE 100 forms HCP precipitates that can significantly reduce ductility. Other known cobalt-based alloys such as the Stellite alloys are strengthened by primary carbides that also can limit ductility and formability. In contrast, the disclosed alloys are strengthened by precipitates that are about 100 nm or less in diameter.

Figure 1:
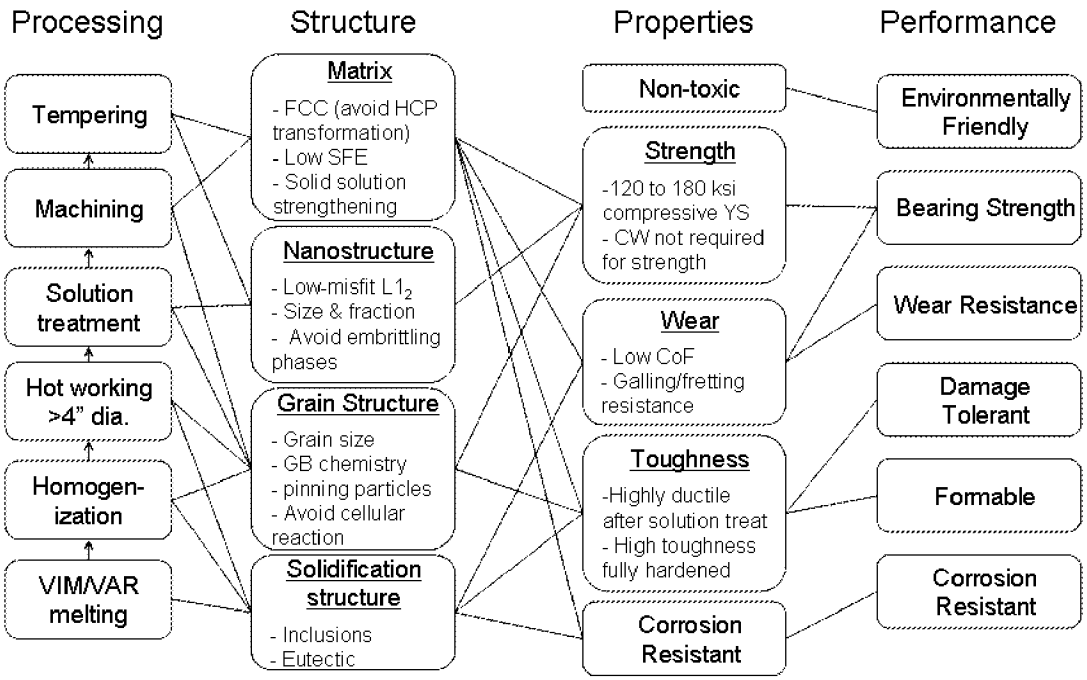
FIG. 1 is a systems-design chart illustrating processing-structure-property relationships of non-limiting embodiments of alloys falling within the scope of the disclosure.

Referring to FIG. 1, in an aspect, the disclosure relates to an alloy that generally includes a low-misfit nanostructure in a cobalt-based FCC matrix. Such alloys would be useful for manufactured articles including, but not limited to, the main landing gear, lugs for attaching the wings, and vertical tail hinge assembly of an aircraft. Additionally, the alloys would be useful for manufactured articles such as gun barrels and liners. The alloys would also be useful for numerous other applications wherein a low-misfit nanostructure in a cobalt-based FCC matrix is desired. As illustrated in FIG. 1, a set of suitable alloy properties can be selected depending on the desired performance of the manufactured article, namely, environmental friendliness, bearing strength, wear resistance, damage tolerance, formability, and corrosion resistance. Suitable alloy properties include non-toxicity, strength of about 830 MPa to about 1240 MPa without requiring warm working or cold working, a low coefficient of friction, a good resistance to galling and fretting, high toughness, and corrosion resistance. These alloy properties can be achieved by structural characteristics such as an FCC matrix that avoids transformation to HCP and shows a low stacking-fault energy and solid solution strengthening; a low-misfit nanostructure such as of an $L1_2$ phase with a suitable size and fraction, the nanostructure avoiding embrittling phases; a grain structure with a suitable grain size and pinning particles, avoiding cellular reaction at the grain boundaries; and a solidification path that ends in a eutectic phase. Alloys exhibiting these structural characteristics can be accessed through the sequential processing steps shown on the left of FIG. 1. The microstructural features affected during the processing steps are connected by lines to each processing step.

The nanostructure in the disclosed alloys can be an $L1_2$ or γ' phase based on $Co_3Ti$. The disclosed alloys can reduce the lattice-parameter misfit between the precipitate phase and the FCC matrix, and thereby substantially avoid discontinuous grain boundary reactions or cellular growth reactions at the grain boundaries. It is contemplated that the interphase misfit and the precipitation of HCP η-$Ni_3Ti$ particles can result in discontinuous grain boundary reactions or cellular growth reactions at the grain boundaries. The disclosed alloys include a suitable content of vanadium, iron, or tungsten, or a combination thereof to reduce the interphase misfit and thereby substantially avoid discontinuous grain boundary reactions or cellular growth reactions at the grain boundaries. The vanadium, iron, and/or tungsten atoms can partition at least in part to the $Co_3Ti$-based precipitate and reduce the lattice-parameter misfit. For example, the lattice parameter of the FCC matrix in the disclosed alloys is about 0.356 nm, and Fe, V, and/or W are expected to reduce the $L1_2$ lattice parameter from about 0.361 nm of pure $Co_3Ti$ to 0.359 nm or less to reduce the lattice-parameter misfit.

Still referring to FIG. 1, in a further aspect, the disclosure relates to an alloy that generally stabilizes the FCC matrix. The FCC matrix in cobalt-based alloys is metastable compared to the HCP structure, and therefore there is a tendency for FCC to transform to HCP at temperatures ranging from room temperature to a higher tempering temperature. The disclosed alloys include suitable contents of iron and nickel to substantially prevent the transformation from FCC to HCP while avoiding the formation of detrimental phases such as the $Fe_2Ti$ Laves-phase and the η-$Ni_3Ti$ phase.

In embodiments, the disclosure relates to an alloy comprising, by weight, about 10% to about 20% chromium, about 4% to about 7% titanium, about 1% to about 3% vanadium, 0% to about 10% iron, less than about 3% nickel, 0% to about 10% tungsten, less than about 1% molybdenum, and the balance of weight percent comprising cobalt and incidental elements and impurities. It is noted that the embodiments described herein include a variation in each constituent of plus or minus ten percent of the recited value or values. It is also understood that the alloys described herein may consist only of the above-mentioned constituents or may consist essentially of such constituents, or in other embodiments, may include additional constituents.

To select compositions with a suitable microstructure, solidification paths and thermodynamic equilibria at various temperatures can be calculated with thermodynamics calculation packages such as Thermo-Calc® software version N offered by Thermo-Calc Software AB of Sweden and a cobalt-based database that QuesTek Innovations LLC developed based on open-literature data.

Example 1

Alloy B86

Figure 2:
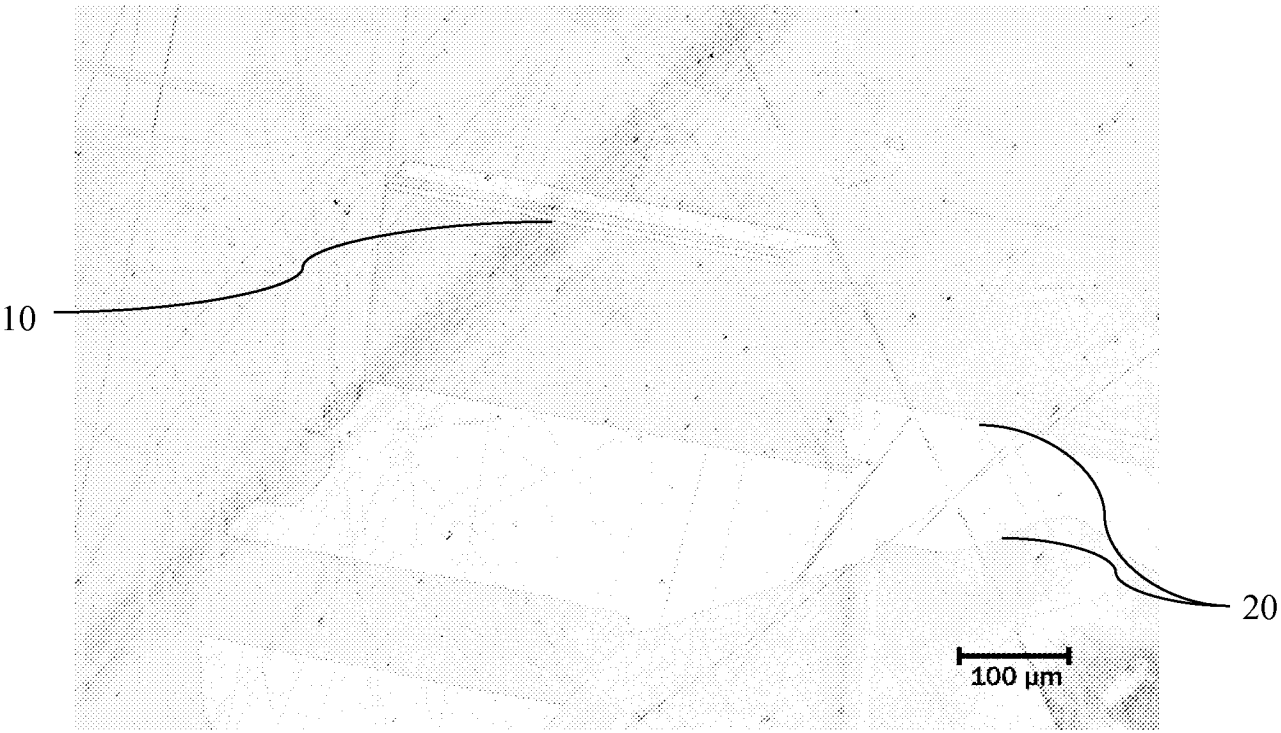
FIG. 2 is an optical micrograph showing a non-limiting embodiment of alloys falling within the scope of the disclosure as described herein including, for example, FIG. 1, wherein the non-limiting embodiment is tempered at about 850° C. for about 8 hours.
Figure 3:
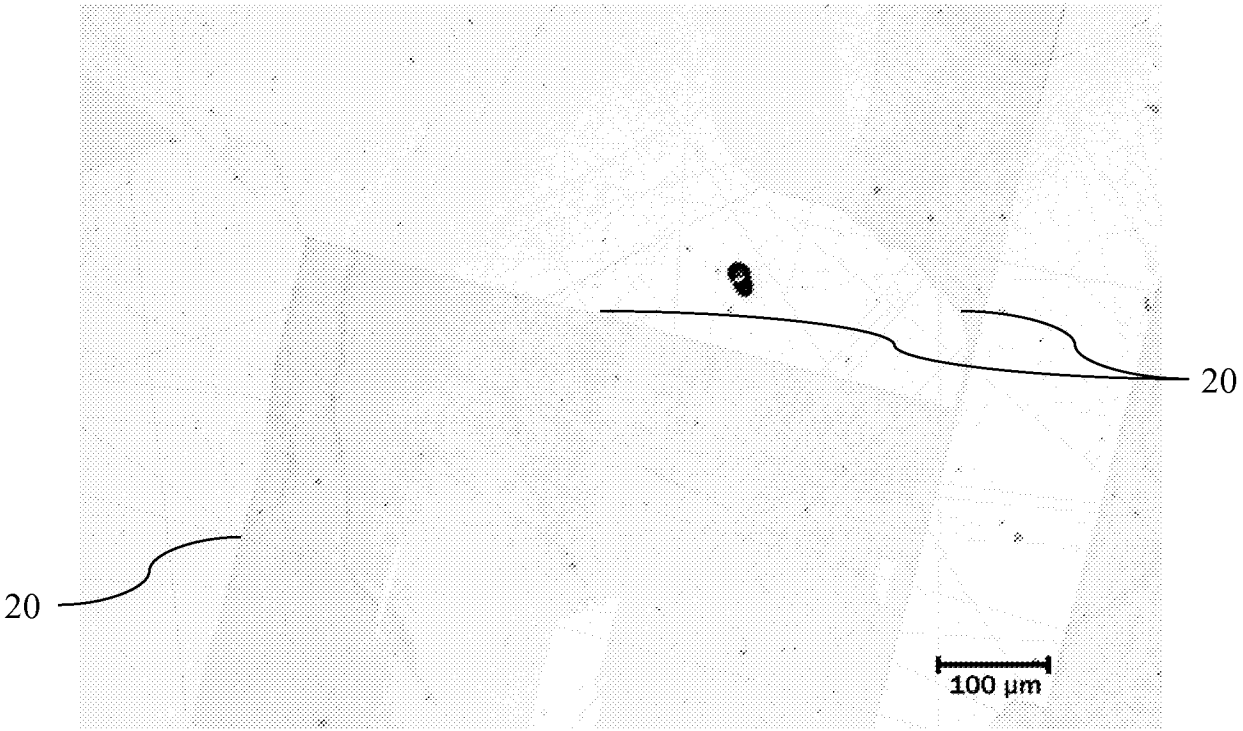
FIG. 3 is an optical micrograph similar to FIG. 2 showing a non-limiting embodiment that is tempered at about 850° C. for about 24 hours.
Figure 4:
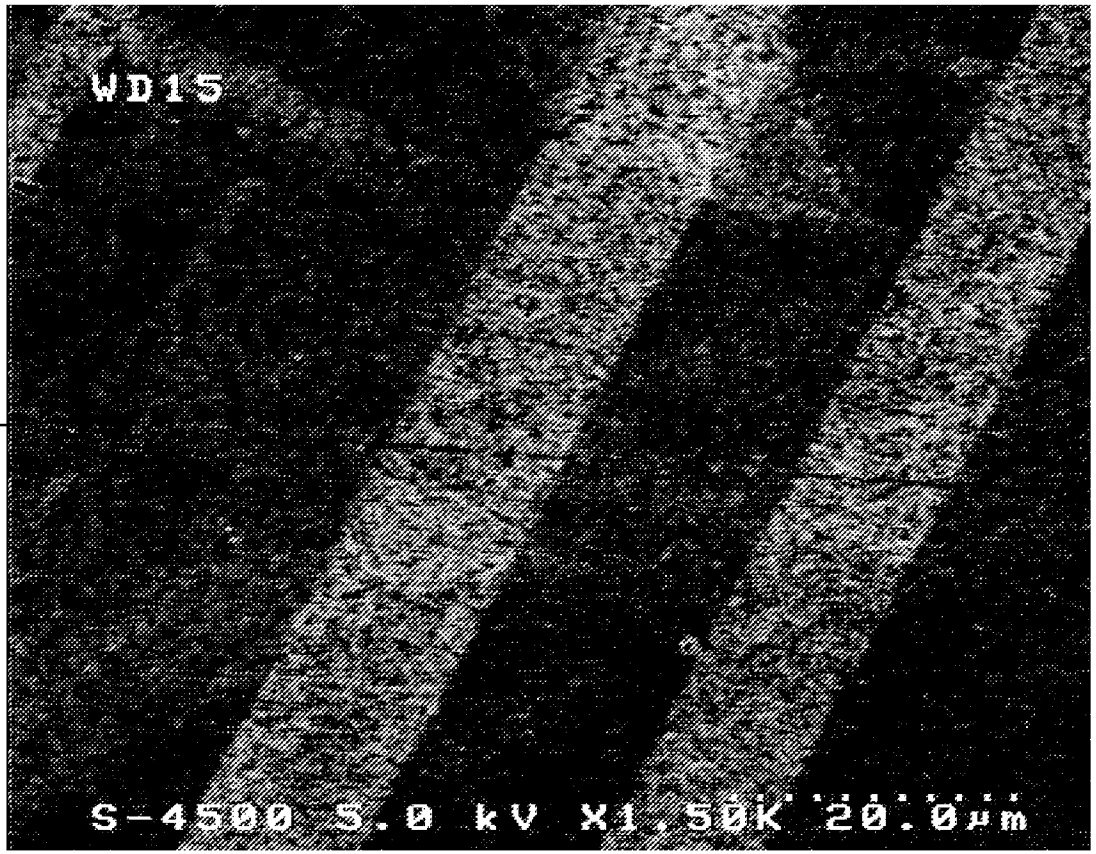
FIG. 4 is a scanning electron microscope image showing a non-limiting embodiment that is tempered at about 850° C. for about 24 hours similar to FIG. 3 but at a higher magnification.
Figure 5:
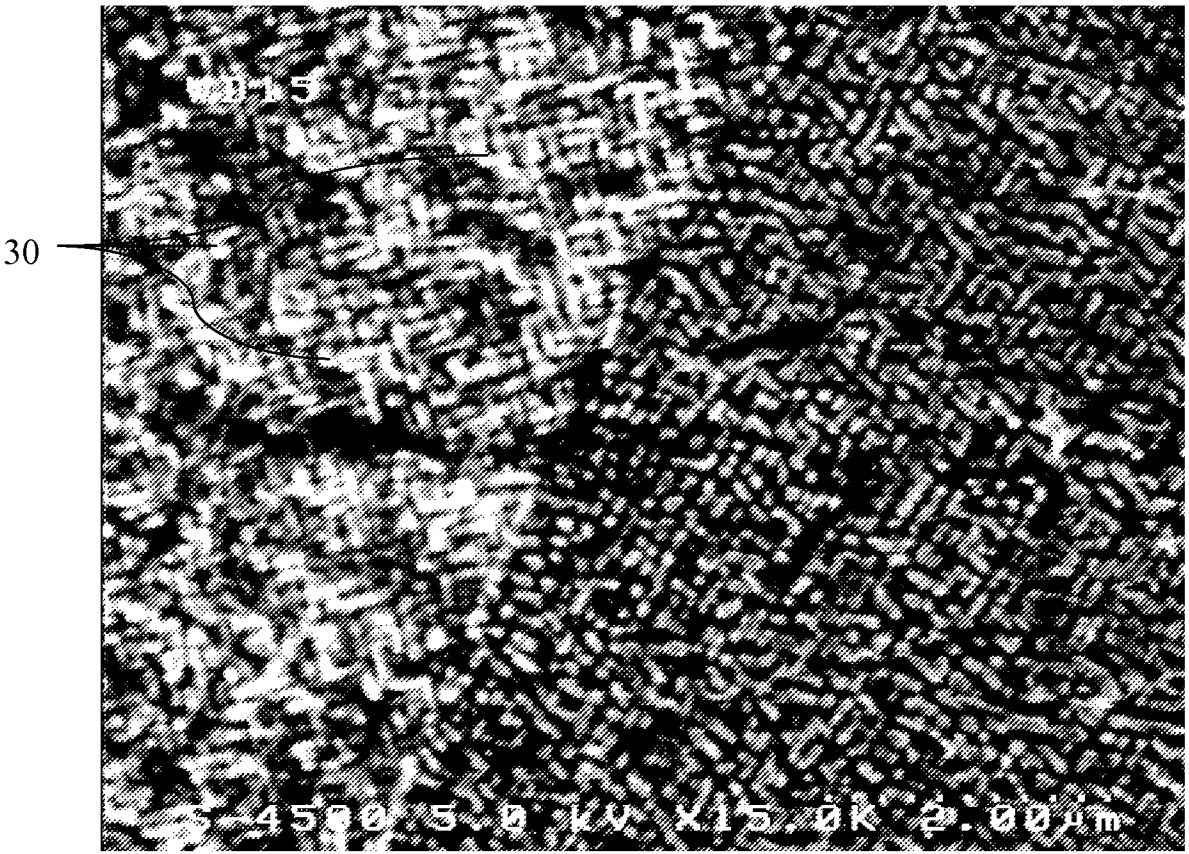
FIG. 5 is a scanning electron microscope image showing nano-scale particles that are coherent with the matrix for a non-limiting embodiment of alloys falling within the scope of the disclosure as described herein including, for example, FIGS. 1-4.

A melt was prepared with the nominal composition in weight percentage of 18% Cr, 5.9% Ti, 4% Fe, 1.8% V, 1% Ni, and the balance Co and incidental elements and impurities. As described above, this example alloy includes a variance in the constituents in the range of plus or minus ten percent of the mean (nominal) value. The alloy in this example was arc-melted as a button. For some applications, the alloy can be prepared by investment casting. The as-melted button was subjected to a homogenization and solution heat treatment at about 1060° C., and tempered at about 850° C. As illustrated in FIG. 2, alloy B86 tempered at about 850° C. for about 8 hours shows annealing twins 10, indicative of an FCC matrix with low stacking-fault energy. The sample tempered at about 850° C. for about 8 hours is substantially devoid of discontinuous grain boundary reactions, cellular growth reactions, or unusual particles at the grain boundaries 20. As illustrated in FIG. 3, the sample tempered at about 850° C. for about 24 hours also is substantially devoid of discontinuous grain boundary reactions, cellular growth reactions, or unusual particles at the grain boundaries 20. Referring also to FIG. 4, scanning electron microscopy shows the annealing twins 10 for a sample tempered at about 850° C. for about 24 hours, at a higher magnification compared to FIG. 2. Referring also to FIG. 5, the sample tempered at about 850° C. for about 24 hours shows precipitates 30 that are about 100 nm or less in diameter. The nano-scale particles 30 are regularly shaped and aligned, indicative of being coherent with the matrix.

Figure 6:
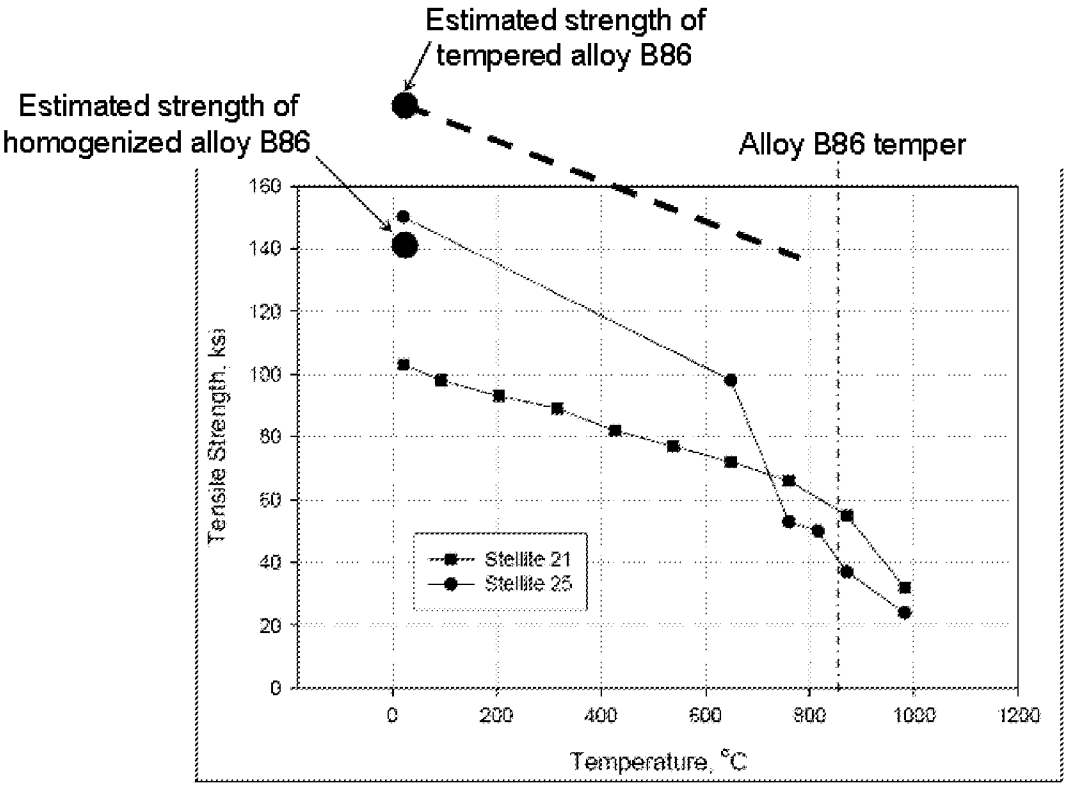
FIG. 6 is a graph plotting the estimated tensile strength of non-limiting embodiments of alloys within the scope of the disclosure as described herein including, for example, FIGS. 1-5, against the reported strength of known alloys, namely Stellite 21 and Stellite 25.

Referring to FIG. 6, the Vickers hardness number of alloy B86 increases from about 310 in the homogenized state to about 377 following tempering for about 24 hours at about 850° C. As shown in the following Table I, these hardness values are estimated to correlate to about 970 and about 1240 MPa in ultimate tensile strength (UTS) at room temperature, respectively, which is a significant improvement over known alloys like the Stellite alloys or ACUBE in the non-worked condition. For example, cast Stellite 21 may achieve about 710 MPa in UTS; powder metallurgy Stellite 21 may achieve about 1000 MPa in UTS; cast Stellite 25 is fractured-limited due to low ductility and therefore UTS is not reported; L605 (with the nominal composition in weight percentage of 10% Ni, 20% Cr, 15% W, 1.5% Mn, 0.33% C, 3% Fe, 0.4% Si, and the balance Co and incidental elements and impurities) is a common modification of Stellite 25 for wrought products with higher ductility and the UTS is 862 MPa at room temperature. It is contemplated that the strength of alloy B86 could be further increased through optional cold working.

TABLE I

| | Measured hardness (VHN) | Estimated Ultimate Tensile Strength (MPa) |
|---|---|---|
| Homogenized | 310 ± 14.5 | 970 |
| 8 hr Temper at 850° C. | 357 ± 11.3 | |
| 24 hr Temper at 850° C. | 377 ± 4.5 | 1240 |

Example 2

Alloy 1A

A melt was prepared with a measured composition in weight percentage of 17.5% Cr, 7.7% Fe, 5.2% Ti, 2.6% Ni, 2.2% V, and the balance Co and incidental elements and impurities. This example alloy includes a variance in the constituents in the range of up to plus or minus two weight percents. The alloy was vacuum-induction-melted and vacuum-arc-remelted to a cylindrical billet measuring about 10.2 cm in diameter and weighing about 13.6 kg. The as-cast billet was subjected to a homogenization and solution heat treatment at about 1050° C. for 72 hours. An outer layer of the billet was removed, resulting in a round bar measuring about 8.9 cm in diameter. The round bar was hot-rolled at Special Metals, Huntington, W. Va. The hot rolling was performed at about 1000° C. for a reduction ratio of about eight to one, resulting in a round-cornered square bar measuring about 3.2 cm in one edge. Specimens were excised from the hot-rolled bar and subjected to a sub-solvus heat treatment and an aging heat treatment.

As listed in the following Table II, the aged alloy 1A shows a UTS comparable to a copper-beryllium alloy according to aerospace material specifications (AMS) 4533, at a much higher elongation compared. The wear resistance of the aged alloy 1A is significantly improved compared to the Cu—Be alloy, as demonstrated by lower coefficients of friction, volume loss, and wear rate.

TABLE II

| Material Property | | Alloy 1A | Cu—Be alloy (AMS 4533) |
|---|---|---|---|
| Compressive Yield Strength (MPa) | | 830 | 1160 |
| Tensile Yield Strength (MPa) | | 820 | 1140 |
| Tensile UTS (MPa) | | 1340 | 1260 |
| Elongation (%) | | 40 | 5.4 |
| Coefficient of Friction | Pin-On-Disk Wear | 0.240 | 0.647 |
| | Reciprocating Wear | 0.511 | 0.785 |
| Volume Loss ($mm^3$) | Pin-On-Disk Wear | 0.046 | 0.925 |
| | Reciprocating Wear | 0.095 | 0.512 |
| Wear Rate ($10^{-5}$ $mm^3/m$) | Pin-On-Disk Wear | 13.73 | 277.00 |
| | Reciprocating Wear | 28.60 | 153.91 |

It is understood that the disclosure may embody other specific forms without departing from the spirit or central characteristics thereof. The disclosure of aspects and embodiments, therefore, are to be considered as illustrative and not restrictive. While specific embodiments have been illustrated and described, other modifications may be made without significantly departing from the spirit of the invention. Unless noted otherwise, all percentages listed herein are weight percentages.

The invention claimed is:

1. An alloy consisting of, by weight, about 10% to about 20% chromium, about 4% to about 7% titanium, about 1% to about 3% vanadium, 0% to about 10% iron, less than about 3% nickel, 0% to about 10% tungsten, less than about 1% molybdenum, and the balance of weight percent cobalt and incidental elements and impurities.

2. The alloy of claim 1, wherein the alloy comprises a low-misfit nanostructure.

3. The alloy of claim 1, wherein the alloy substantially avoids discontinuous grain boundary reactions or cellular growth reactions at grain boundaries.

4. The alloy of claim 1, wherein the alloy is characterized by an ultimate tensile strength of about 830 to about 1240 MPa at room temperature.

5. The alloy of claim 1, wherein the alloy is fabricated by investment casting.

6. An alloy made by a process comprising the steps of:

preparing a melt that consists of, by weight, about 10% to about 20% chromium, about 4% to about 7% titanium, about 1% to about 3% vanadium, 0% to about 10% iron, less than about 3% nickel, 0% to about 10% tungsten, less than about 1% molybdenum, and the balance of weight percent cobalt and incidental elements and impurities;

cooling the melt to room temperature;

subjecting the alloy to a homogenization and solution heat treatment at about 1060° C. to about 1125° C.; and tempering the alloy at about 750° C. to about 850° C. for about 8 hours to about 26 hours.

7. The alloy of claim 6, wherein the alloy comprises a low-misfit nanostructure.

8. The alloy of claim 6, wherein the alloy substantially avoids discontinuous grain boundary reactions or cellular growth reactions at grain boundaries.

9. The alloy of claim 6, wherein the alloy is characterized by an ultimate tensile strength of about 830 to about 1240 MPa at room temperature, and wherein the steps substantially avoid warm working.

10. The alloy of claim 6, wherein the preparation of the melt includes investment casting.

11. A manufactured article comprising an alloy that consists of, by weight, about 10% to about 20% chromium, about 4% to about 7% titanium, about 1% to about 3% vanadium, 0% to about 10% iron, less than about 3% nickel, 0% to about 10% tungsten, less than about 1% molybdenum, and the balance of weight percent cobalt and incidental elements and impurities.

12. The article of claim 11, wherein the alloy comprises a low-misfit nanostructure.

13. The article of claim 11, wherein the alloy substantially avoids discontinuous grain boundary reactions or cellular growth reactions at grain boundaries.

14. The article of claim 11, wherein the alloy is characterized by an ultimate tensile strength of about 830 to about 1240 MPa at room temperature.

15. The article of claim 11, wherein the article is fabricated by investment casting.

16. The article of claim 11, wherein the alloy is made by a process including the steps of:

preparing a melt that consists of, by weight, about 10% to about 20% chromium, about 4% to about 7% titanium, about 1% to about 3% vanadium, 0% to about 10% iron, less than about 3% nickel, 0% to about 10% tungsten, less than about 1% molybdenum, and the balance of weight percent cobalt and incidental elements and impurities;

cooling the melt to room temperature;

subjecting the alloy to a homogenization and solution heat treatment at about 1060° C. to about 1125° C.; and tempering the alloy at about 750° C. to about 850° C. for about 8 hours to about 26 hours.

17. The article of claim 16, wherein the preparation of the melt includes investment casting.

18. The article of claim 11, wherein the alloy is characterized by an ultimate tensile strength of about 830 to about 1240 MPa at room temperature, and wherein the steps substantially avoid warm working.

19. A process for preparing an alloy, the process comprising preparing a melt that consists of, by weight, about 10% to about 20% chromium, about 4% to about 7% titanium, about 1% to about 3% vanadium, 0% to about 10% iron, less than about 3% nickel, 0% to about 10tungsten, less than about 1% molybdenum, and the balance of weight percent cobalt and incidental elements and impurities;

cooling the melt to room temperature;

subjecting the alloy to a homogenization and solution heat treatment at about 1060° C. to about 1125° C.; and tempering the alloy at about 750° C. to about 850° C. for about 8 hours to about 26 hours.

20. The process of claim 19, wherein preparing the melt includes investment casting.

* * * * *